33-241 SR
8/30/83 XR 4,400,887

United States Patent [19]
Mason

[11] 4,400,887
[45] Aug. 30, 1983

[54] ARCHERY BOW SIGHT

[76] Inventor: John D. Mason, 4115 Silverleaf Cove, Memphis, Tenn. 38115

[21] Appl. No.: 284,456

[22] Filed: Jul. 16, 1981

[51] Int. Cl.[3] ..... F41G 1/32
[52] U.S. Cl. ..... 33/265; 33/241
[58] Field of Search ..... 33/241, 265, 283, 284; 124/87; 250/215

[56] References Cited

U.S. PATENT DOCUMENTS 3,163,937 1/1965 Reynolds ..... 33/265
3,945,127 3/1976 Spencer ..... 33/265

*Primary Examiner*—Harry N. Haroian
*Attorney, Agent, or Firm*—Walker & McKenzie

[57] ABSTRACT

A bow sight for use with an archery bow. The bow sight includes a plurality of sight pins attached to the bow for use in aiming the bow at a target and includes a mechanism for causing one of the sight pins to glow so as to be readily distinguishable from the other of the sight pins depending on the angle at which the bow is held.

7 Claims, 8 Drawing Figures

ARCHERY BOW SIGHT

BACKGROUND OF THE INVENTION

1. Field of the Invention

The present invention relates to a mechanism for use with an archery bow to aid in the aiming of the bow at a target.

2. Description of the Prior Art

Heretofore, various mechanisms have been developed for use to aid in the aiming of an archery bow at a target. See, for example, Jordan, U.S. Pat. No. 3,289,300; Spencer, U.S. Pat. No. 3,945,127; LeFebvre, U.S. Pat. No. 4,048,726; Keller, U.S. Pat. No. 4,120,096; Mann, U.S. Pat. No. 4,170,071; Koren, U.S. Pat. No. 4,179,613; and Robinson, U.S. Pat. No. 4,195,414. None of the above patents disclose or suggest the present invention.

Archery bows are commonly used in the hunting of deer and other game animals. A normal practice in the hunting of such game animals with an archery bow is to wait in an elevated position (e.g., a "tree stand" that may be approximately 8–16 feet above the ground or the like) for the animal to pass by. A major problem associated with such procedures is that of judging the distance from the bow to the target when looking down on the target from the elevated position.

SUMMARY OF THE INVENTION

The present invention is directed toward alleviating the above mentioned problem of judging distance from an elevated position. The concept of the present invention is to provide an archery bow sight with means which will determine which of several sight pins for the archer to use in aiming at a target from an elevated position based on the distance and/or angle between the bow and the target and cause that specific sight pin to be readily distinguishable from the other sight pins.

The bow sight of the present invention includes, in general, a plurality of sight pins for being mounted on an archery bow and for selective use by the archer in aiming at the target; and control means for causing a specific one of the sight pins to be readily distinguishable from the other of the sight pins when the bow is pointed at the target.

DESCRIPTION OF THE PREFERRED EMBODIMENT

Figure 1:
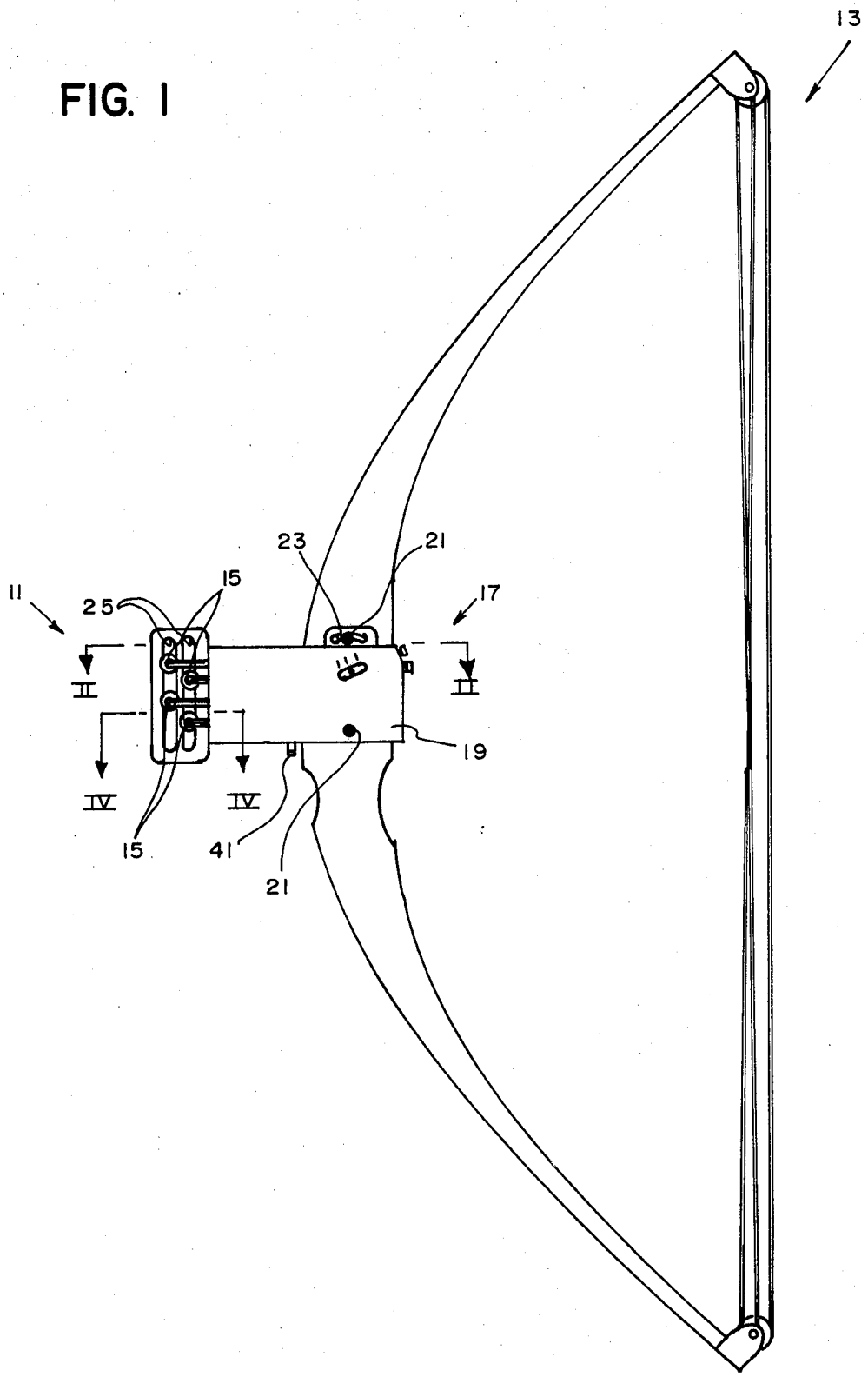
FIG. 1 is a side elevational view of a standard compound-type archery bow shown with the bow sight of the present invention attached thereto.
Figure 2:
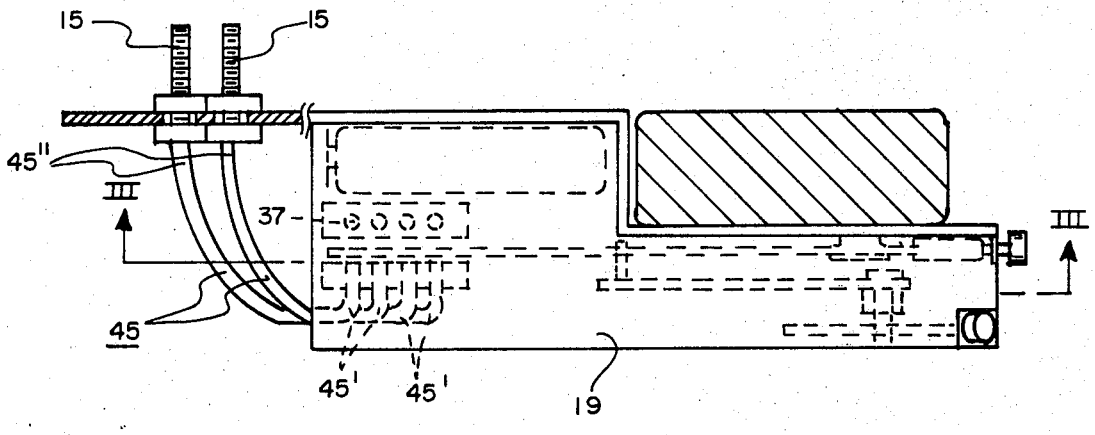
FIG. 2 is a sectional view as taken on line II—II of FIG. 1.

The bow sight 11 of the present invention is for use in combination with an archery bow 13 to aid an archer in aiming the bow 13 at a target from an elevated shooting position. The bow 13 may be of standard construction well known to those skilled in the art. For example, the bow 13 may be a compound type bow as shown in FIG. 1. The bow sight 11 comprises, in general, a plurality of sight pins 15 for being mounted on the bow 13 and for selective use by the archer in aiming the bow 13 at a target; and control means 17 for causing a specific one of the sight pins 15 to be readily distinguishable from the other of the sight pins 15 depending on the angle at which the bow 13 is held.

The sight pins 15 and control means 17 are preferably mounted to a housing member 19. The housing member 19 is preferably adjustably mounted to the bow 13 by way of screws 21 or the like. Preferably, the housing member 19 has a curved slot 23 therein through which one of the screws 21 extends (see FIG. 1) to allow the bow sight 11 to be adjusted relative to the center line of the bow 13. The housing member 19 preferably includes a pair of elongated slots 25 for receiving the sight pins 15 and for allowing vertical adjustment of the sight pins 15 relative to the bow 13.

Figure 4:
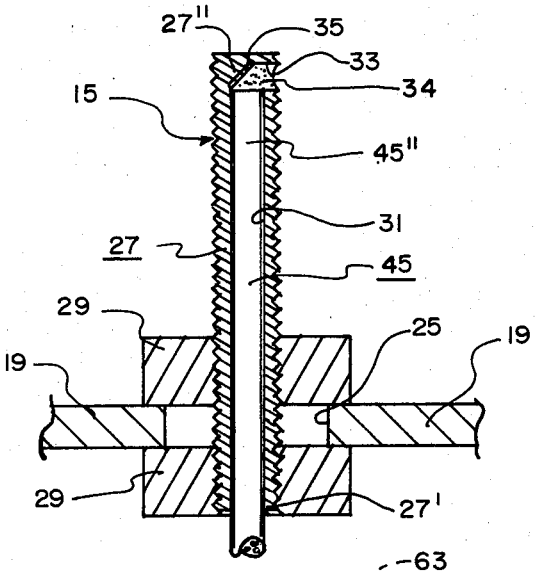
FIG. 4 is a sectional view as taken on line IV—IV of FIG. 1 with certain portions broken away for clarity.

Each sight pin 15 may include an externally threaded elongated rod 27 for extending through one of the slots 25, and a pair of nut members 29 for engaging the rod 27 and attaching the rod 27 to the housing member 19 as clearly shown in FIG. 4. The sight pins 15 are horizontally adjustable in a manner which is well-known to those skilled in the art. Each rod 27 has an aperture 31 extending along the longitudinal axis thereof from the first end 27' thereof substantially to the second end 27'' thereof. A transverse aperture 33 extends from the exterior of each rod 27 adjacent the second end 27'' thereof to the aperture 31. A reflective member 35 is positioned substantially at a 45° angle at the junction of the apertures 31, 33 as clearly shown in FIG. 4 and for reasons which will hereinafter become apparent. The transverse aperture 33 is preferably filled with a clear, transparent plastic 34 or the like for reasons which will hereinafter become apparent.

Figure 8:
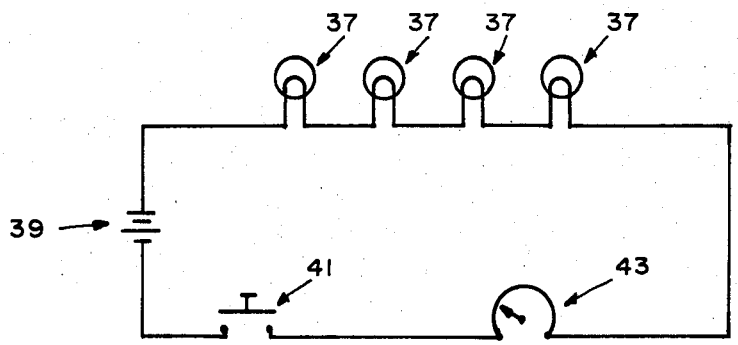
FIG. 8 is an electrical schematic of certain electrical components of the present invention.

The control means 17 preferably includes light means such as, for example, a plurality of light bulbs 37 electrically coupled to a source of electrical energy such as a battery 39 as clearly shown in FIG. 8. A push button switch 41 and a rheostat 43 are preferably positioned between the battery 39 and light bulbs 37 as shown in FIG. 8. The switch 41 is preferably located so that the user of the bow 13 can readily activate the light bulbs 37 while pointing the bow 13 at a target (see FIG. 1).

The bow sight 11 preferably includes transfer means for transferring light from the light bulbs 37 to the sight pins 15. The transfer means preferably consist of elongated fiber optic members 45 extending between each sight pin 15 and such light bulb 37 whereby the light from a specific light bulb 37 will be transferred to a specific sight pin 15 in a manner as will now be apparent to those skilled in the art. Each fiber optic member 45 has a first end 45' for being positioned substantially adjacent one of the light bulbs 37 for receiving light therefrom and has a second end 45'' for being inserted into the aperture 33 in one of the sight pins 15 for directing light from one of the light bulbs 37 to the reflective member 35 of one of the sight pins 15. The fiber optic member 45 will thus cause the transverse apertures 33 of each of sight pin 15 to glow or "lite-up" when the switch 41 is closed to activate the light bulbs 37.

Figure 3:
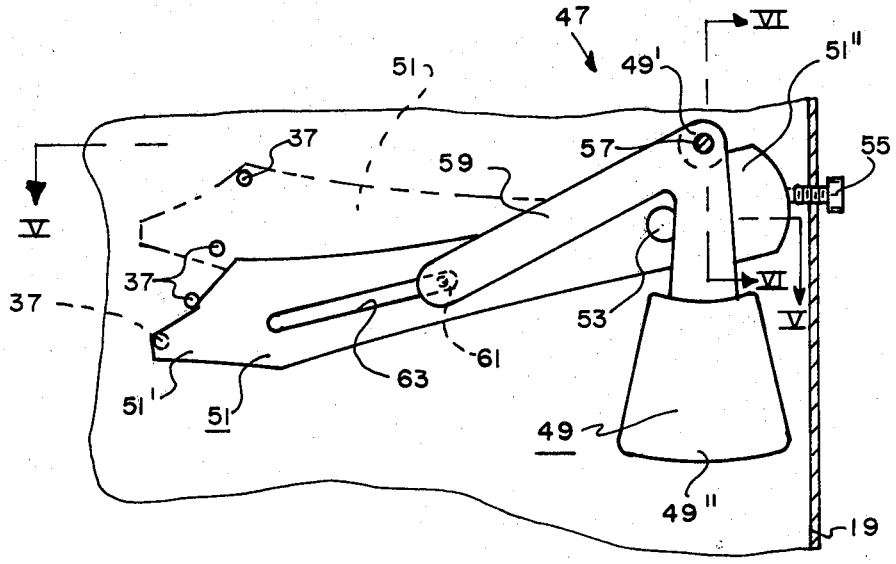
FIG. 3 is a sectional view as taken on line III—III of FIG. 2 with certain portions broken away for clarity.
Figure 5:
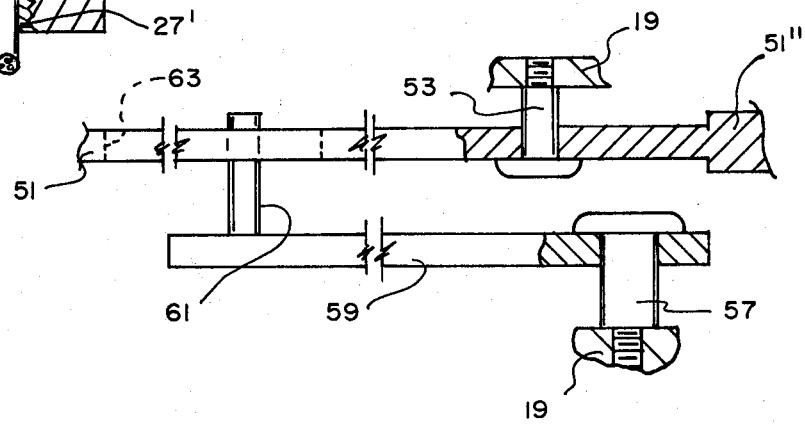
FIG. 5 is a sectional view substantially as taken on line V—V of FIG. 3 with certain portions broken away for clarity.

The control means 17 preferably includes a pendulum means 47 for movement in response to the angle in which the bow 13 is held and for causing a specific one of the sight pins 15 to glow so as to be readily distinguishable from the other of the sight pins. The pendulum means preferably includes a pendulum member 49 for being pivotally attached to the bow 13 and for maintaining a substantially vertical position regardless of the angle at which the bow 13 is held, and preferably includes an arm member 51 for being moved by the pendulum member 49 for controlling the transfer of light between the light bulbs 37 and the sight pins 15. The arm member 51 has a first end 51' and a second end 51'' and is pivotally mounted to the housing member 19 by way of a pivot member 53 (which may consist of a screw). At least the first end 51' of the arm member 51 preferably has a distinctively colored translucent portion for being positioned between one of the light bulbs 37 and the first end 45' of one of the fiber optic members 45 to cause the light being transferred from that specific light bulb 37 to that fiber optic member 45 to be distinctively colored. For example, at least the first end 51' of the arm member 51 might be constructed of a transparent red plastic whereby the light being transferred there through will be colored red thus causing one of the sight pins 15 to distinctively glow red. The second end 51'' of the arm member 51 may be enlarged so as to act as a counterweight to substantially balance the arm member 51 about the pivot member 53. A lock screw 55 may be provided for selectively preventing movement of the arm member 51 such as when the bow 13 is in transit or when it is desired to use the sight pins 15 in the normal manner such as when hunting at ground level in a manner which will now be apparent (see FIG. 3). The pendulum member 49 has a first end 49' and a second end 49''. A pivot member 57 such as a screw pivotally mounts the first end 49' of the pendulum member 49 to the housing member 19. The second end 49'' of the pendulum member 49 is weighted so as to cause the pendulum member 49 to maintain a substantially vertical position regardless of the angle at which the bow 13 is held in a manner as will now be apparent to those skilled in the art. The pendulum member 49 may have an offset portion 59 for coacting with the arm member 51 to cause the arm member 51 to pivot about the pivot member 53 in response to the angle at which the bow 13 is held. More specifically, the offset portion 59 may be provided with a finger member 61 for coacting with an elongated slot 63 in the arm member 51 (see, in general, FIGS. 3 and 5). Thus, movement of the pendulum member 49 due to a change in the angle at which the bow 13 is held when pointed at a target will cause the arm member 51 to move whereby the first end 51' of the arm member 51 will be positioned between a specific one of the light bulbs 37 and a specific one of the first end 45' of the fiber optic members 45 causing the second end 45'' of that specific fiber optic member 45 to glow distinctively to indicate to the archer to use that sight pin 15 to aim the bow 13 at the target.

Figure 6:
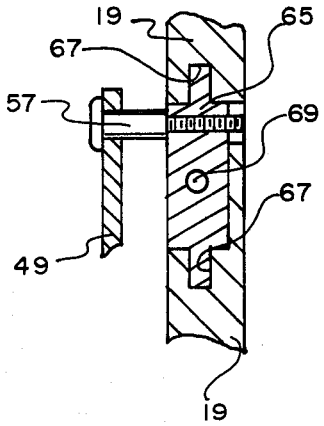
FIG. 6 is a sectional view as taken on line VI—VI of FIG. 3 with certain portions broken away for clarity.
Figure 7:
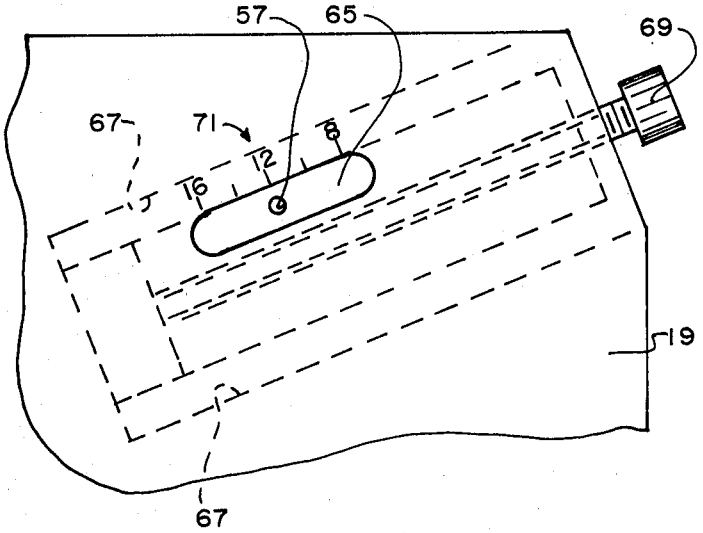
FIG. 7 is an enlarged side elevational view of a portion of the bow sight of the present invention.

The pivot member 57 is preferably moveable in order to adjust the bow sight 11 for use from elevated shooting positions of varying heights. More specifically, the pivot member 57 is preferably attached to a slide or plate member 65 which is slidably mounted in tracks 67 in the housing member 19 (see, in general, FIGS. 6 and 7). A screw member 69 may be provided for moving the plate member 65 back and forth along the tracks 67. Indicia 71 may be provided on the housing member 19 adjacent the plate member 65 for various heights that correspond to various elevated shooting positions. The correct height adjustment depends on various factors such as the sizes and lengths of the pendulum member 49 and arm member 51, the location of the plate member 65, etc. It should be noted that the proper location of the sight pins 15 in the slots 25 depends on various factors such as the strength of the bow 13, the strength of the archer, etc., and should be initially set in a trial-and-error type manner for any specific bow sight 11 and bow 13.

The operation of the bow sight 11 is quite simple. First, the bow sight 11 is attached to the bow 13 by way of the screws 21 or the like. The sight pins 15 can be adjusted up and down along the slots 25 so that each sight pin 15 can be used by the archer to aim the bow 13 at targets at varying distances. The archer then determines the height of the elevated position at which he will be shooting the bow 13 and adjust the plate member 65 accordingly. For example, the archer may measure 40 yards on a level spot and then adjust the lowermost sight pin 15 in a trial-and-error manner so that he hits the target placed 40 yards from the bow 13 when using the lowermost sight pin 15 (this is identical to setting prior art sight pin aiming mechanisms). Next, the archer gets in the elevated shooting position and sets the plate member 65 for the height of that shooting position. When the bow 13 is then aimed at a target 40 yards from the bow 13, the lowermost sight pin 15 should glow distinctively (e.g., turn red-pink). If the lowermost sight pin 15 does not glow distinctively, the housing member 19 should be moved on the bow 13 until the lowermost sight pin 15 does glow (this sets the bow sight to a specific bow 13). The other sight pins 15 are then adjusted in a normal manner. Once the sight pins 15 have been thus set, readjustment will not be necessary when shooting positions are changed, just adjustment of the plate member 65 according to the height of the new shooting positions. When the archer aims the bow 13 at a target from the elevated position, the pendulum means 47 will cause a specific sight pin 15 to glow distinctively to indicate that the archer use that specific sight pin 15 when aiming at the target. It should be noted that the first end 51' of the arm member 51 may be shaped so as to cover two of the light bulbs 37 when the bow 13 is held at certain angles. For example, the four sight pins 15 may be set to be used by the archer at distances corresponding substantially to 10, 20, 30 and 40 yards respectively and the pendulum means 47 set so as to cause a specific sight pin 15 to distinctively glow when the bow 13 is held at an angle which indicates that the target is approximately 10, 20, 30 or 40 yards from the bow 13. However, if the target is at an intermediate distance (e.g., 15, 25 or 35 yards), the first end 51' of the arm member 51 will cover two adjacent sight pins 15 (see the broken line shown in FIG. 3) and cause those two adjacent sight pins 15 to glow distinctively to indicate to the archer to use a space between those two sight pins 15 to sight at the target. It should be noted that the reflective members 35 of each sight pin 15 will allow the archer to easily distinguish the lighted sight pins 15 even in bright sunshine and the like while preventing the light from being seen from the front of the bow 13. The rheostat 43 allows the intensity of the light bulbs 37 to be varied under different light conditions, etc.

Although the invention has been described and illustrated with respect to a preferred embodiment thereof and a preferred use therefore, it is not to be so limited since changes and modifications can be made which are within the full intended scope of the invention.

I claim:

1. The combination with an archery bow of a bow sight for aiding an archer in aiming the bow at a target from an elevated shooting position, said bow sight comprising:

(a) a plurality of sight means for being mounted on the bow and for selective use by the archer in sighting on the target;

(b) control means for causing a specific one of said sight means to be readily distinguishable from the other of said sight means, said control means including means responsive to the angle in which the bow is held and for causing a specific one of said sight means to be readily distinguishable from the other of said sight means depending on the angle in which the bow is held.

2. The combination with an archery bow of a sight for aiding an archer in aiming the bow at a target from an elevated shooting position, said bow sight comprising:

(a) a plurality of sight pins for being mounted on the bow and for selective use by the archer in sighting on the target;

(b) control means for causing a specific one of said sight pins to be readily distinguishable from the other of said sight pins, said control means including light means and including pendulum means for movement in response to the angle in which the bow is held and for causing a specific one of said sight pins to glow so as to be readily distinguishable from the other of said sight pins; and (c) transfer means for transferring light from said light means to said sight pins.

3. The combination of claim 2 in which said pendulum means includes a pendulum member for being pivotally attached to said bow and for maintaining a substantially vertical position regardless of the angle at which said bow is held, and includes an arm member for being moved by said pendulum member and for controlling the transfer of light from said light means to said sight pins.

4. The combination of claim 3 in which said light means includes a plurality of light sources; in which said transfer means includes a plurality of fiber optic members, each of said fiber optic members having a first end for being attached to one of said sight pins and including a second end for being positioned adjacent one of said light sources to transfer light from one of said light sources to one of said sight pins; and in which said arm member of said pendulum means has a distinctively colored translucent portion for being positioned between one of said light sources and said second end of one of said fiber optic members for causing said first end of said first optic member to glow distinctively.

5. The combination of claim 4 in which said light means includes a source of electrical energy, includes an electric circuit for electrically coupling said source of electrical energy to said plurality of light sources and for allowing electrical energy to pass from said source of electrical energy to said plurality of light sources, and includes a switch means positioned in said electric circuit between said source of electrical energy and said plurality of light sources to control the passage of electrical energy between said source of electrical energy and said plurality of light sources.

6. The combination of claim 3 in which is included a pivot member for pivotally attaching said pendulum member to said bow, in which is included a pivot member for pivotally attaching said arm member to said bow, and in which is included a slide member for allowing said pivot member that attaches said pendulum member to said bow to be moved relative to said pivot member that attaches said arm member to said bow to allow said bow sight to be adjusted to shooting positions of different elevations.

7. The combination of claim 5 in which is included a rheostat positioned in said electric circuit between said source of electrical energy and said plurality of light sources.

* * * * *